United States Patent [19]

Dalle

[11] 4,213,761

[45] Jul. 22, 1980

[54] PROCESS FOR TREATING CELLULOSIC MATERIALS WITH LIQUID AMMONIA

[76] Inventor: Jean-Paul Dalle, 4917 Big Bend, Wichita Falls, Tex. 76310

[21] Appl. No.: 883,193

[22] Filed: Mar. 3, 1978 (Under 37 CFR 1.47)

Related U.S. Application Data

[63] Continuation of Ser. No. 580,705, May 27, 1975, abandoned.

[30] Foreign Application Priority Data

May 28, 1974 [FR] France ..... 74 18331

[51] Int. Cl.[2] ..... D06B 7/04; D06B 7/08

[52] U.S. Cl. ..... 8/125

[58] Field of Search ..... 8/125

[56] References Cited

U.S. PATENT DOCUMENTS

| | | | |
|---|---|---|---|
| 3,406,006 | 10/1968 | Lindberg et al. | 8/125 |
| 3,560,140 | 2/1971 | Gailey | 8/125 |
| 3,767,359 | 10/1973 | Calamari et al. | 8/125 |
| 3,849,067 | 11/1974 | Calamari et al. | 8/125 |

FOREIGN PATENT DOCUMENTS

| | | | |
|---|---|---|---|
| 1365706 | 9/1974 | United Kingdom | 8/125 |

*Primary Examiner*—John Kight, III

*Attorney, Agent, or Firm*—Lewis H. Eslinger

[57] ABSTRACT

A process for treating textile materials such as yarns, fabrics or the like is taught. The specific improvement lies in impregnating the textile material with ammonia and applying to the impregnated material stresses of about 25% to 30% of the breaking load of that material for ten or more seconds; thereafter removing a first portion of ammonia to reduce the degree of impregnation to less than 75% by weight after less than 3 seconds while stresses are reduced to about 15% of the breaking load of the material; removing a second portion of the ammonia such that the degree of impregnation is less than 30% by weight after less than 60 seconds, while stresses remain approximately the same as those in the preceding step; and finally removing the balance of the impregnated ammonia while maintaining the stresses below 5% of the breaking load of the textile material, the ammonia being removed at such a rate that the degree of impregnation is less than 15% by weight after less than 300 seconds. All of the time intervals for ammonia removal are measured from the start of ammonia removal.

4 Claims, 7 Drawing Figures

30%
40%
55%
70%
150%
0
-10%
-20%
Shrinkage of warp
0
5
10
15
20
25
Time in seconds STRESSES (% of breaking load)
10
5
I
II
III
-20
0
20
40
60
TIME/Sec.

$NH_3$ (% by weight)
200
150
100
50
-20
0
20
40
60
TIME/sec.

PROCESS FOR TREATING CELLULOSIC MATERIALS WITH LIQUID AMMONIA

This application is a continuation in part of Ser. No. 580,705, filed May 27, 1975 and now abandoned.

The present invention relates to a process for the mercerization of cellulosic materials with liquid ammonia, intended to improve their properties such as tensile strength, elongation at rupture, gloss, dimensional stability, dye affinity and pill resistance.

The mercerization of natural or regenerated cellulosic fibres with a solution of liquid ammonia has proved promising since 1897. According to Mercer, a swelling reagent is reacted on a material and this reagent is removed whilst the material is subjected to a minimum of stresses. According to Lowe, a swelling reagent is reacted, but the material is subjected to considerable stresses when the reagent is removed, with a view to minimising its shrinking.

The two general processes which have just been recalled have various drawbacks but enable products to be obtained which have common properties Improved dye affinity Increased suppleness in humid state Partial disappearance of the crystalline domaines of the cellulose.

More recent processes are also known.

U.S. Pat. No. 1,998,551 describes a process for treating yarns or fabrics, based on natural or regenerated cellulose, by liquid ammonia. A weak or zero tension is maintained for the duration of the treatment. In this way, the tensile strength, extensibility and lustre are increased.

U.S. Pat. No. 3,560,140 describes a process consisting in applying ammonia onto a material in the relaxed state or not, then in stretching this material by 10 to 30%, during the ammonia removing step. In this way, the tensile strength is substantially improved.

However, these two processes suffer from certain disadvantages in their application, since they necessitate:

a measurement of the shrinking of the material after it has been impregnated with the liquid ammonia, a control of the tensions to be applied to the material when the liquid ammonia is removed.

It is thus difficult to obtain regularity of the results.

U.S. Pat. No. 3,406,006 describes a process consisting in treating a cellulosic material with a view to obtaining a product having a good extensibility. To obtain such a result, the fabric is impregnated with ammonia for at least 15 seconds. During the swelling and/or slow removal of the ammonia, obtained by evaporation, the fabric is maintained under a minimum or low stress which enables the desired strong extensibility to be obtained.

However, the following drawbacks are observed:

poor dye affinity poor dimensional stability no gloss too much extensibility

Finally, British Pat. No. 1,365,706 describes a process for mercerizing a cellulosic fabric with liquid ammonia, with a view to reducing the shrinking provoked by the treatment to a minimum. To this end, the complete removal of the ammonia must be effected quickly, between 0.6 and 9 seconds.

However, such a process comprises various drawbacks:

the dye affinity is insufficient dimensional stability remains mediocre since the action of the ammonia is incomplete poor gloss It is immediately seen that, in the last two processes which have been described, certain advantages of the treatment are relinquished in order not to suffer certain drawbacks. In particular, part of the dye affinity, part of the dimensional stability and part of the tensile strength are abandoned to avoid too great a shrinking and in order not to lose too large a quantity of fabric surface.

In summary, none of the known processes makes it possible to obtain, at the same time, all the properties mentioned hereinbefore and generally sought in mercerized materials.

This is why, to obtain a product having a satisfactory group of properties, the invention proposes a process of mercerization with liquid ammonia, which is characterised by several steps:

(a) impregnation of the material with liquid ammonia;

(b) reduction of the degree of ammonia (c) complete removal of ammonia.

During these three stages, the treated material is subjected to predetermined stresses as will be seen from the following description. The stresses which will be applied to the plasticized material may be, at least partially, present in the material before the first step in order to prevent shrinking due to the action of ammonia. In fact they only need to be sufficient for maintaining the original dimensions of the material.

(a) Impregnation of the material with liquid ammonia.

Stresses of between about 25 and 30% of the breaking load are applied to the material plasticized by the liquid ammonia.

The plasticized material will preferably contain between 75 and 200% of ammonia. The stresses will be applied to this plasticized material for a period of time longer than 1 second and preferably longer than 10 seconds. These conditions allow a complete action of the ammonia on the material to be obtained.

The action of the ammonia may be effected by any known means such as immersion in a bath of liquid ammonia or the spraying of ammonia on the material. The ammonia may contain up to about 20% of water. This action is known to bring about a considerable shrinking of the material which must be limited due to the application of the stresses to the plasticized material.

The period of time during which the impregnated material is maintained under stress must be longer than 1 second, but preferably, and for practical reasons, it is included between 10 and 60 seconds. A longer period is not necessary since it does not produce any novel property.

(b) Reduction of the degree of ammonia

In a first step, the ammonia is removed so that the degree of impregnation is less than 75% in less than 3 seconds; at the same time, the stresses are reduced from their initial value to about 15% of the breaking load.

The removal of the ammonia is continued so that the degree of impregnation is less than 30% in less than 60 seconds; the stresses are maintained substantially constant, i.e. close to 15% of the breaking load. In this way, the passage from the plastic state under stress to the plastic state without stress is effected fairly rapidly and avoids too considerable a shrinking of the treated material.

The shrinking will be even more limited if the degree of ammonia is returned to less than 75% in less than one second and to less than 30% in less than 20 seconds. Therefore, for this step, methods are used which allow a sudden removal of the greater part of the ammonia contained in the material.

(c) Complete removal of the ammonia.

The complete removal of the small quantity of ammonia remaining in the material is then continued, applying to the material only zero or weak stresses, necessary for its displacement and its subsequent packing, i.e. less than 5% of the breaking load. The duration of this step must be short but may, however, exceed a few minutes if necessary. This removal may be effected by any conventional method such as addition of calories, dissolution of the ammonia in water, immersion in a dye bath. Preferably, no more than 300 seconds must elapse before the degree of ammonia is returned to 15%.

The application of the stresses is effected by maintaining the material on a rigid support; this method gives the greatest regularity in the properties obtained. Any other method of application of the stresses also enters within the scope of the present invention provided that these stresses are applied on a material plasticized by ammonia and that the complete removal of the ammonia is effected after the stresses have been released. The material is then no longer plastic and its speed of deformation is very slow. However, even if the material is still plastic, it is returned to a non-plastic state before having had to time to shink substantially.

Finally, it is to be noted that the material may be treated in any form, and particularly in the form of yarns, sheets, woven fabrics, knitted fabrics.

The invention will be more readily understood on reading the following description with reference to the accompanying drawings, in which.

Figure 2:
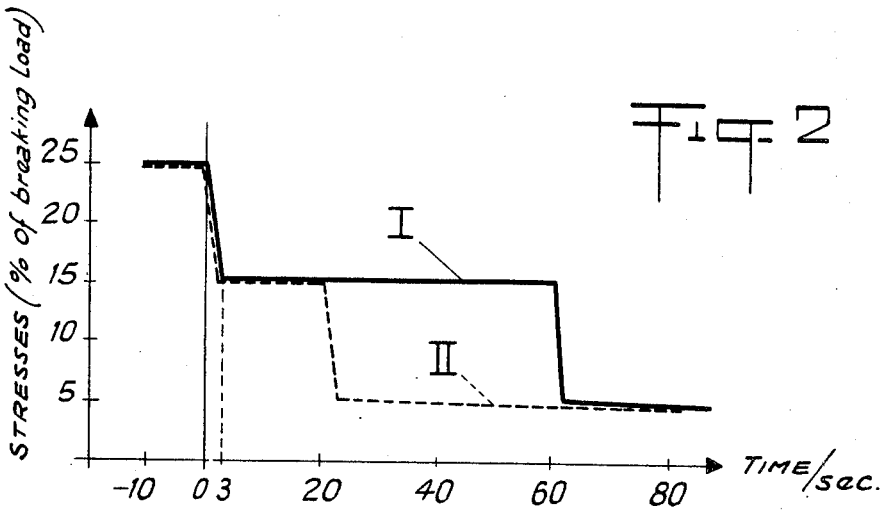
FIG. 2 shows a diagram of the stresses as a function of time, according to the present invention.
Figure 3:
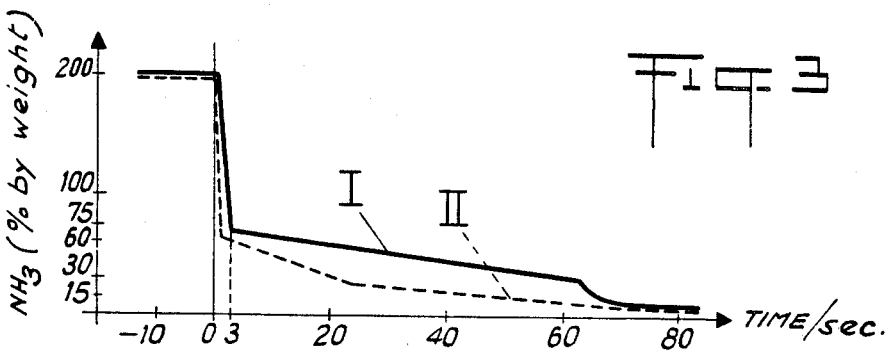
FIG. 3 represents a diagram of the development of the degree of ammonia as a function of time, according to the invention.
Figure 4:
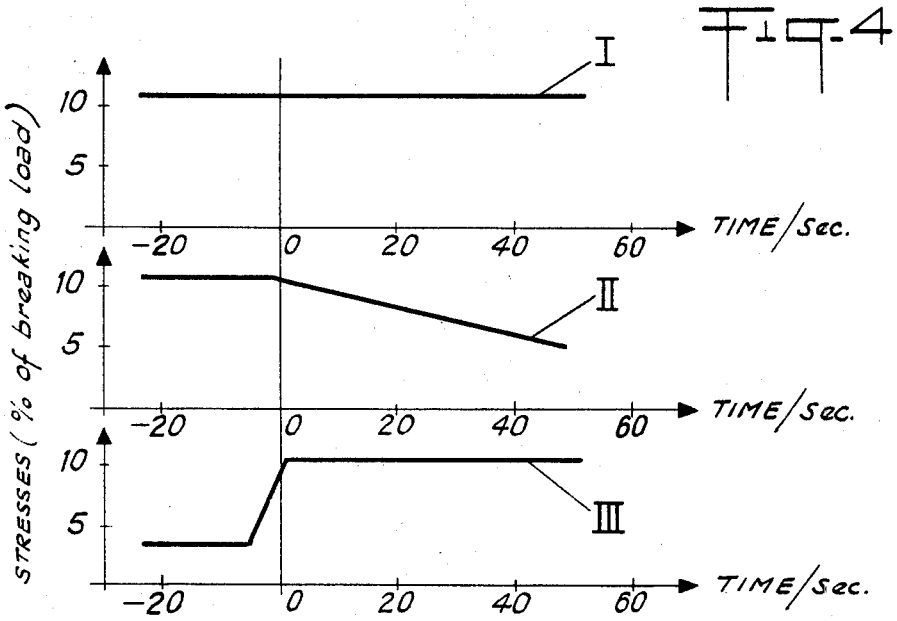

FIGS. 4 and 5, 6 and 7 are diagrams similar to those of FIGS. 2 and 3, in the case of U.S. Pat. No. 3,406,006 and of British Pat. No. 1,365,706, respectively.

It is known that pure cellulose is of weak plasticity which is increased by the presence of liquid ammonia and becomes considerable when the percentage of liquid ammonia becomes greater than 75%. In fact, the free molecules of ammonia act as plasticizer. Moreover, the concentration of ammonia in the cellulosic material influences the speed of deformation. The higher the concentration of ammonia, the more the deformations, both in shrinking and in extension under stress, are rapid.

Figure 1:
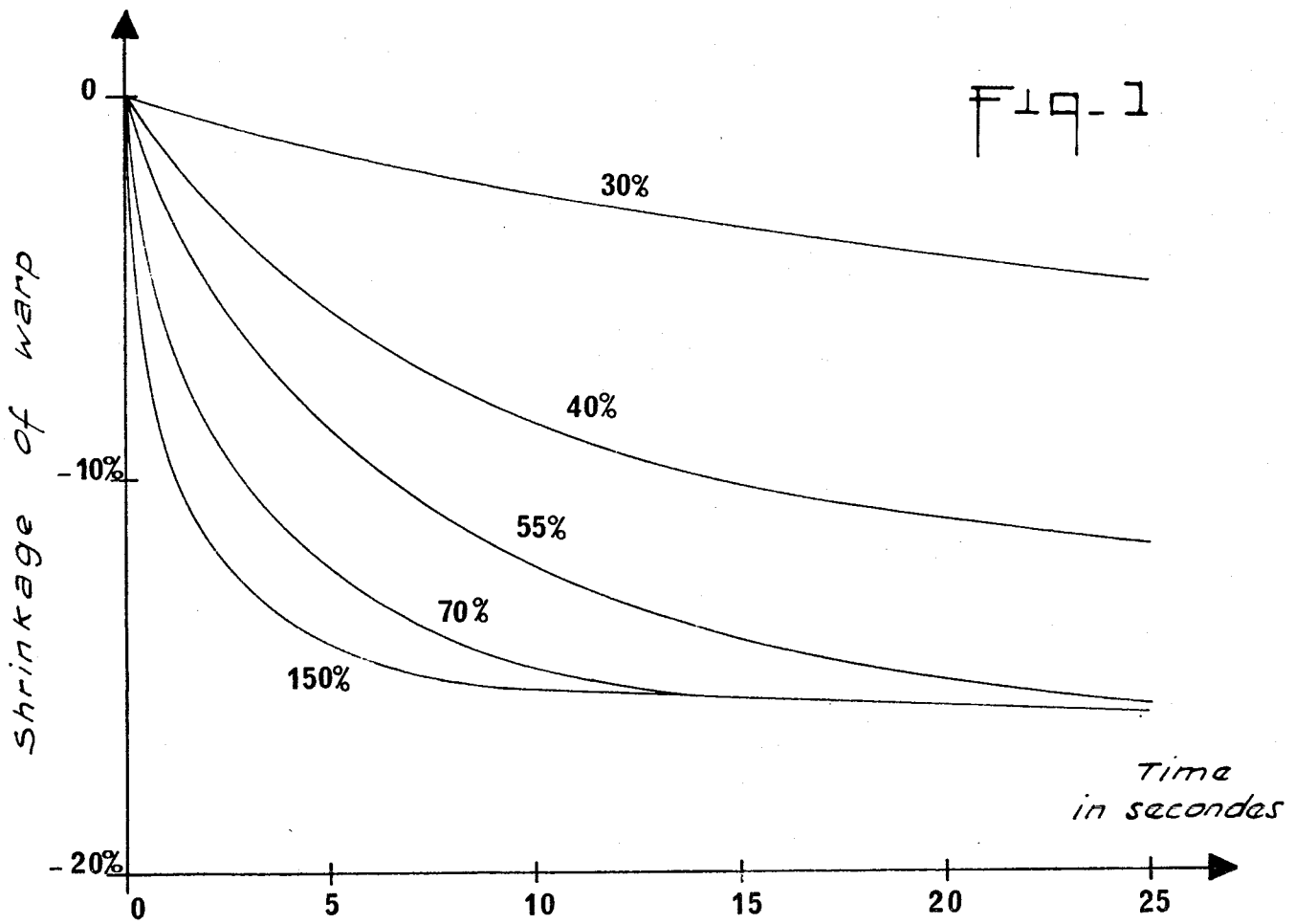
FIG. 1 shows the degrees of shrinking, as a function of time, of a cellulosic material impregnated with different quantities of liquid ammonia.

This is clearly shown in FIG. 1 where it has been considered that the concentration of ammonia remains constant for the whole duration of the shrinking. The instant 0 corresponds to the elimination of any stress in the material which may thus shrink freely. It is seen for example that a shrinking of 10% is obtained after 1.5 seconds with a degree of ammonia of 150% and after 16.5 seconds with a degree of ammonia of 40%. When the concentration of ammonia increases, the plasticity of the material and the speed of the deformations increase. In particular, these two properties undergo a very important increase for a content of ammonia close to 75% by weight in the cellulose, i.e. when the zone of the non-linked ammonia is reached.

In the process according to the invention, any shrinking is avoided or at least, in practice, the shrinking is limited for the duration of the impregnation by maintaining the material under stress. However, these stresses must be progressively eliminated when the degree of ammonia in the material reduces and, particularly, during drying to avoid the destruction of certain properties of the material.

As has been mentioned hereinabove, FIGS. 2 and 3 illustrate the three steps of removal of the ammonia and the corresponding variation of the stresses expressed in percentage of the breaking load of the material. The instant 0 corresponds to the beginning of the removal of ammonia, the times prior to instant 0 corresponding to the impregnation by ammonia with a degree close to 200% by weight.

The solid-line curves of FIGS. 2 and 3 correspond to a first embodiment and the broken-line curves to a second embodiment enabling the shrinking after treatment to be limited as much as possible.

The following examples are intended to demonstrate the advantage of the present mode of treatment over the known processes. The samples treated are knitted cotton fabrics weighing 200 gr., on average, per square meter.

EXAMPLE 1

Samples 1, 2, 3 and 4 (Table I) are treated according to the present invention, i.e. according to the diagrams of FIGS. 2 and 3.

The knitted fabric is immersed in a bath of liquid ammonia for a sufficient length of time, close to 20 seconds, for the degree of impregnation to be between 150 and 200%. The knitted fabric is delivered by rubber-coated steel rollers, under a tension of between 25 and 30% of the breaking load.

The knitted fabric then circulates on rollers in hot water for 3 seconds and the degree of impregnation of ammonia becomes lower than 75%. At the same time, the tension of the knitted fabric is lowered to about 15% of the breaking load.

Circulation is continued for 60 seconds, the tension remaining substantially constant and the degree of impregnation reduces to about 30% (Test I, FIG. 2, samples 1 and 2 of Table I).

The circulation in hot water may be limited to about 20 seconds under a substantially constant stress, the degree of impregnation again being reduced to about 30% due to a greater flow of water (Test II, FIG. 2, samples 3 and 4 of Table I).

Finally, the remaining ammonia is removed completely, in about two minutes, the stress being reduced to less than 5% of the breaking load.

EXAMPLE 2

Samples 5, 6, 7, 8, 9, 10 (Table I) are mercerized with liquid ammonia according to the process described in U.S. Pat. No. 3,406,006 shown in the diagrams of FIGS. 4 and 5.

The impregnation of the samples and the progressive removal of the ammonia as well as the application of the stresses are effected in the same installation as the one used in Example 1.

However, in Test I (FIG. 4) to which samples 5 and 6 (Table I) correspond, the stresses are maintained constant for the whole duration of the treatment and close to 10% of the breaking load.

In Test II (samples 7 and 8, Table I), the stresses are slowly reduced during the removal of the ammonia.

In Test III (samples 9 and 10, Table I), no stress exists during the impregnation phase but stresses close to 10% of the breaking load are applied during the removal of the ammonia.

Figure 5:
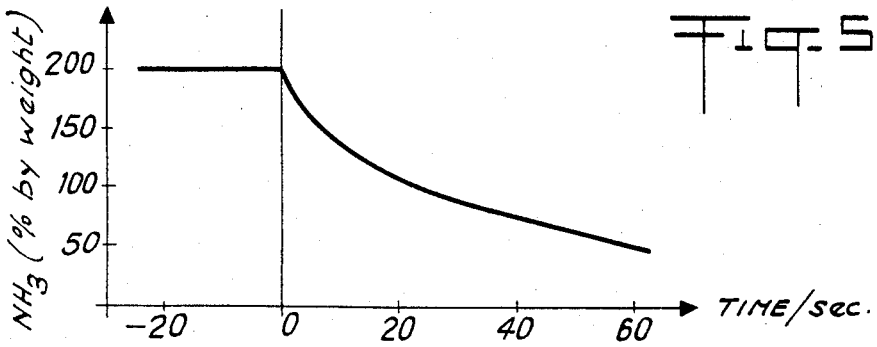
Figure 6:
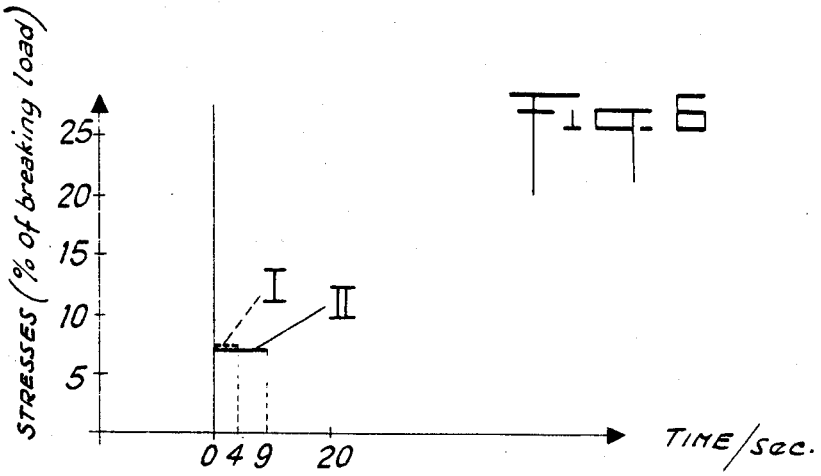
Figure 7:
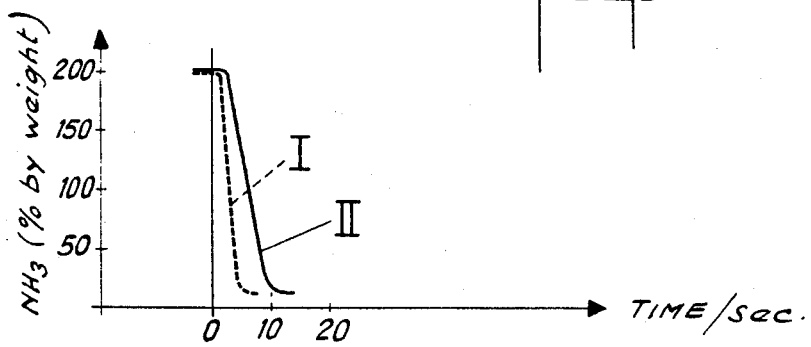

However, in the three cases, the removal of the ammonia takes place slowly (FIG. 5).

EXAMPLE 3

Samples 11, 12, 13, 14 (Table II) are mercerized by liquid ammonia according to the process described in British Pat. No. 1,365,706 shown in the diagrams of FIGS. 6 and 7.

The same installation is used as in the case of Example 1.

In test I (FIGS. 6 and 7), the residence time as defined in British Pat. No. 1,365,706 is close to 4 seconds; samples 11 and 12 (Table I) correspond to this test. In Test II (FIGS. 6 and 7), the residence time is close to 9 seconds. Samples 13 and 14 (Table I) correspond to this test.

In both cases, the tension remains weak and close to 7% of the breaking load and the ammonia is removed virtually completely, this enabling too considerable a shrinkage during treatment to be avoided.

Table I indicates the results of the measurements carried out on samples 1 to 14 treated according to Examples 1 to 3; to be able to compare the treatments and the efficiency of the treatment according to the invention (Example 1) more readily, the same measurements have been made on non-treated samples 15 and 16. All the tests and measurements were carried out by the Institut Textile de France.

After being treated, all the samples were dyed simultaneously by means of a direct dye for cotton, called "Direct Blue No. 1" at a concentration of 1% by weight, in the presence of sodium sulphate. In this way, the dye affinity of each sample was able to be determined.

The determination of the dimensional stability after washing was conducted according to French standard G 07.127. Washing was effected for 40 minutes at a temperature of between 89° and 95° C. in the presence of detergents.

Three rinsings lasting 5 minutes were followed by a drying lasting 2 minutes.

The tensile strength was measured on a SCOTT-TESTER dynamometer according to standard ASTM D 39/49 on samples 5 cm in length.

Finally, the measurement of the pill resistance was made according to standard G 07.121 on a ZWEIGLE pilling meter. The grades, from 1 to 5, are as follows:

Grade 1: very intense pilling
Grade 2: intense pilling
Grade 3: average pilling
Grade 4: weak pilling
Grade 5: zero pilling Two measurements were made, one after 4 hours, the other after 16 hours, in the pilling meter.

Table II summarizes the interpretation of the results of Table I and enables the advantages obtained by the invention to be observed.

TABLE I

| | Samples | NO TREATMENT | | | Samples | EXAMPLE 1 | | | Samples | EXAMPLE 2 | | | Samples | EXAMPLE 3 | | |
|---|---|---|---|---|---|---|---|---|---|---|---|---|---|---|---|---|
| DYE AFFINITY | 15<br>16 | Check samples | | | 1<br>2<br>3<br>4 | Very good and largely improved with respect to check samples | | | 5<br>6<br>7<br>8<br>9<br>10 | Poor | | | 11<br>12<br>13<br>14 | Medium | | |
| | | Side Direction | Mesh Direction | | | Side Direction | Mesh Direction | | | Side Direction | Mesh Direction | | | Side Direction | Mesh Direction | |
| DIMENSIONAL STABILITY | 15<br>16 | −6,40<br>−5,60 | −10,35<br>−8,50 | −6,00%<br>−9,42% | 1<br>2 | −6,75<br>−6,75 | +6,00<br>+6,20 | −6,75%<br>+6,10% | 5<br>6 | −11,70<br>−9,85 | +10,50<br>+8,20 | −10,77<br>+9,35% | 11<br>12 | −3,75<br>−4,90 | +6,50<br>+7,85 | −4,32%<br>+7,17% |
| | | | | | 3<br>4 | −6,80<br>−5,50 | +6,20<br>+7,00 | −6,15%<br>+6,60% | 7<br>8 | −12,70<br>−12,25 | +7,25<br>+9,00 | −12,47%<br>+8,12% | 13<br>14 | −13,75<br>−16,35 | +13,60<br>+19,10 | −15,05%<br>+16,35% |
| | | | | | | | | | 9<br>10 | −11,60<br>−11,35 | +8,35<br>+7,40 | −11,47<br>+7,87% | | | | |
| | | Strength(Kg) | Elong.(%) | | | Strength(Kg) | Elong.(%) | | | Strength(Kg) | Elong.(%) | | | Strength(Kg) | Elong.(%) | |
| STRENGTH AND ELONGATION | 15<br>16 | 31,30<br>31,60 | 93,30<br>99,30 | 31,45<br>96,30 | 1<br>2 | 45,30<br>44,00 | 45,30<br>43,30 | 44,65<br>44,30 | 5<br>6 | 46,00<br>47,30 | 70,00<br>62,60 | 46,75<br>66,30 | 11<br>12 | 43,60<br>44,30 | 107,30<br>95,30 | 43,95<br>101,30 |
| | | | | | 3<br>4 | 46,00<br>48,60 | 49,30<br>54,00 | 47,30<br>51,65 | 7<br>8 | 45,00<br>43,30 | 58,60<br>80,00 | 44,15<br>69,30 | 13<br>14 | 47,30<br>51,60 | 116,60<br>58,00 | 49,45<br>87,30 |
| | | | | | | | | | 9<br>10 | 47,00<br>50,00 | 78,00<br>75,30 | 48,50<br>76,65 | | | | |
| | | After 4 Hours | After 16 Hours | | | After 4 Hours | After 16 Hours | | | After 4 Hours | After 16 Hours | | | After 4 Hours | After 16 Hours | |
| FILLING | 15<br>16 | 4<br>4 | 2<br>2 | 4<br>2 | 1<br>2 | 3<br>4 | 3<br>2 | 3,50<br>2,50 | 5<br>6 | 4<br>3 | 2<br>1 | 3,50<br>1,50 | 11<br>12 | 3<br>4 | 1<br>1 | 3,50<br>1,00 |
| | | | | | 3<br>4 | 3<br>3 | 1<br>2 | 3,00<br>1,50 | 7<br>8 | 2<br>1 | 2<br>1 | 1,50<br>1,50 | 13<br>14 | 3<br>2 | 1<br>1 | 2,50<br>1,00 |
| | | | | | | | | | 9<br>10 | 2<br>2 | 2<br>2 | 2,00<br>2,00 | | | | |

TABLE II

| Example 1 | Example 2 (prior art) | Example 3 (prior art) |
|---|---|---|
| much improved dye affinity | poor dye affinity | medium dye affinity |
| good dimensional stability | bad dimensional stability | poor to bad dimensional stability due to too short and too irregular a treatment and an incomplete action of ammonia |
| increased strength with limited elongation at rupture and extensibility | increased strength but considerable elongation at rupture and extensibility | increased strength but too good an extensibility |
| good resistance to pilling (see average of results 1 to 4: 3,25-2,00) | medium resistance to pilling (see average of results 5 to 10: 3,1-1,6) | very poor resistance to pilling (see average of results 11 to 14; 3,00-1,00 |
| gloss | no gloss | poor gloss |

What is claimed is:

1. In a process for treating a textile material such as yarn, fabric or the like, for the purpose of improving the dye affinity, dimensional stability and tensile strength of the textile material, said material being comprised in part or entirely of natural or regenerated cellulosic fibers, wherein said textile material is impregnated with liquid ammonia in am amount of more than 75% by weight and stresses are applied to said material while it is in a plastic state due to impregnation with ammonia and wherein said stresses are reduced while ammonia is being removed from said textile material, the improvement comprising the steps of:

impregnating said textile material with ammonia and applying stresses to said impregnated material of about 25% to 30% of the breaking load of said material for ten or more seconds;

removing a first portion of said ammonia such that the degree of impregnation is less than 75% by weight after less than 3 seconds while stresses are reduced to about 15% of the breaking load;

removing a second portion of said ammonia such that the degree of impregnation is less than 30% by weight after less than 60 seconds while stresses remain approximately the same as those which were applied during the preceding step;

and removing the balance of the impregnated ammonia while maintaining the stresses below 5% of the breaking load of the said textile material, said ammonia being removed at such rate that the degree of impregnation is less than 15% by weight after less than 300 seconds, wherein all time intervals for ammonia removal are measured from the start of ammonia removal.

2. A process as claimed in claim 1, wherein the degree of impregnation of ammonia after the first ammonia removal step is less than 75% after less than 1 second and is less than 30% after less than 20 seconds.

3. A process as claimed in claim 1, wherein the stresses applied to the said textile material when it is in the plastic state due to the liquid ammonia action are present in said material before its plasticization by the ammonia.

4. A process as claimed in claim 1, wherein the material is in the form of yarns, sheets, woven fabrics or knitted fabrics.

* * * * *